United States Patent [19]

Romualdi et al.

[11] 4,070,427

[45] Jan. 24, 1978

[54] CONCRETE PLANK AND METHOD FOR MAKING IT FOR ELEVATED PLAYING COURT SURFACES

[75] Inventors: James P. Romualdi; Samuel M. Bell, both of Pittsburgh, Pa.

[73] Assignee: Samuel M. Bell, Pittsburgh, Pa.

[21] Appl. No.: 718,384

[22] Filed: Aug. 27, 1976

Related U.S. Application Data

[63] Continuation-in-part of Ser. No. 566,309, April 9, 1975, abandoned, which is a continuation-in-part of Ser. No. 402,346, Oct. 1, 1973.

[51] Int. Cl.[2] ..... B28B 1/08; B28B 3/20

[52] U.S. Cl. ..... 264/71; 264/174; 264/176 R; 52/177

[58] Field of Search ..... 52/659, 177; 264/174, 264/176, 177, 228, 333, 71

[56] References Cited

U.S. PATENT DOCUMENTS

| | | | |
|---|---|---|---|
| 1,530,630 | 3/1925 | Tucker | 52/662 |
| 2,252,980 | 8/1941 | Rhett | 52/368 |
| 3,146,508 | 9/1964 | Berliner | 264/228 X |
| 3,429,094 | 2/1969 | Romualdi | 52/659 |
| 3,510,547 | 5/1970 | Eisler | 264/316 X |

FOREIGN PATENT DOCUMENTS

| | | | |
|---|---|---|---|
| 279,585 | 11/1927 | United Kingdom | 52/368 |

OTHER PUBLICATIONS

Design and Control of Concrete Mixtures, 9th ed., Portland Cement Association, Wash. D.C., 1948, p. 44.

*Primary Examiner*—Thomas P. Pavelko
*Attorney, Agent, or Firm*—Buell, Blenko & Ziesenheim

[57] ABSTRACT

A concrete plank and method for making it which duplicates the flexibility of a non-concrete plank of any given thickness which is used for an elevated playing court surface in which the concrete plank has a thickness which follows a given set of parameters. The concrete plank is reinforced with closely spaced layers of mesh.

13 Claims, 2 Drawing Figures

CONCRETE PLANK AND METHOD FOR MAKING IT FOR ELEVATED PLAYING COURT SURFACES

This application is a continuation-in-part of our copending application Ser. No. 566,309 filed Apr. 9, 1975 now abandoned which is a continuation-in-part of our application Ser. No. 402,346, filed Oct. 1, 1973.

This invention relates to a composite mesh reinforced concrete plank and a method of making the same which duplicates a non-concrete plank for use in making elevated playing court surfaces. In particular, this invention is directed to composite mesh reinforced concrete planks and methods for making mesh reinforced concrete planks for use in making elevated platform tennis courts.

PROBLEMS PRESENTED TO THE INVENTORS AND THE PRIOR ART

Platform tennis courts consist of a playing surface which is normally elevated above ground level. The game is traditionally played outdoors during the winter months and provisions must be made to sweep off as now and to allow moisture to drain from the playing surface. For this reason, many courts are constructed of wooden planks laid lengthwise with slight gaps between the boards. The American Platform Tennis Association provides that the typical paddle tennis or platform tennis court be constructed with a deck or flooring of "2 inches × 6 inches decking" which are boards 2 inches thick and 6 inches wide. Alternative materials used for making the decks include aluminum sections, other metals or plywood. Metal decks have the disadvantage of requiring special non-skid surfaces. Also, the metal decks do not have the sound and flexibility to the foot which is produced by the traditional wooden deck. This is objectionable to persons who are normally accustomed to the traditional wooden planks. If a solid plywood deck is used, a slight slope is required for drainage from the accumulated melting snow and rain. Even though there are disadvantages in using metal decks, they are becoming favored because they eliminate the serious problem of rot and decay resulting in high maintenance costs which is the principal disadvantage of wooden decks.

The ideal material would be one which does not rot and yet which has all of the identical flexibility to the human foot play and sound characteristics resulting from the ball as a deck made of wooden planks. Because of the sound problem and the feel, metal cannot be used. Concrete has been considered as a playing surface but its major problem has been capability of handling the stress factors and duplicating the flexibility which is felt by the human foot.

U.S. Pat. No. 3,429,094 specifically relates to the strengthening of concrete by the inclusion of wires of a critical spacing. The teachings of U.S. Pat. No. 3,429,094 are helpful to provide a minimum performance so far as strength is concerned but the U.S. Pat. No. 3,429,094 does not remotely touch the problem with which we are now concerned, namely duplicating by concrete the "sound" and "feel" of the traditional wooden planks used in the playing surface structure. These particular properties relate to "flexibility" or springiness. The predicted tensile strengths needed for platform tennis are only a fraction of what is available when planks are designed in accordance with U.S. Pat. No. 3,429,094.

INVENTORS' SOLUTION TO THE PROBLEM

We believe the solution rests with the use of concrete planks which are made to duplicate the flexibility of a wooden court surface made from wooden planks. Prior to our solution there was no suggestion by the playing court industry or users that the flexibility of a wooden court could be achieved by thin concrete planks in which the thickness of the concrete plank is controlled by deflection considerations. For example, as stated supra there have been expensive attempts to substitute extruded aluminum which have not met with success because of the unfavorable "sound" of the playing surface.

We have invented a new concrete plank and a method for making the same for duplicating the sound and flexibility of the existing wooden planks. The advantage of this is that wooden decks can be partially replaced by rot-proof concrete planks as the wooden planks rot. There can be a mixture in a given court or even from one deck to another of both the wooden planks and the concrete planks. New decks within a club may be added as additional deck playing surfaces without a noticeable change. This, of course, has the advantage that the players cannot distinguish the two types of courts and it does not effect their play in going from a wooden deck to a concrete deck.

It is to be understood that although the invention embodiment is directed to duplicating wooden planks it can also be used to duplicate any non-concrete plank.

The invention comprises using a flexible tough form of reinforced concrete that is resistant to rot, corrosion and fire. It has a flexibility and strength similar to common wood grades and when substituted for wood in platform tennis court playing surfaces, provides a surface with the traditional appearance, sound and feel similar to that of a wooden court. By providing an appropriate finish to the mortar or concrete before it sets, a surface can be made skid resistant and thereby obviate the need for additional maintenance of a non-skid surface. If desired, coloring agents may be added to the cement to provide a permanent color. The concrete deck planks can be separated from the underframe of the platform tennis court by a layer of elastic material such as rubber or similar material to deaden noise and vibrations and generally cushion the deck. In utilizing the concrete surface, heating elements can be inserted or heating fluids with coil can be embedded into the concrete planks to melt the accumulation of snow and ice.

We provide a method for making a composite mesh reinforced concrete plank which duplicates the flexibility of a non-concrete plank of a given thickness and which has sufficient strength for use in an elevated playing court surface which comprises placing layers of mesh within a U-shaped cross-sectional form having a desired length and width of the non-concrete plank to be duplicated, in such a manner that the mesh is generally uniform and consistently distributed over the length, width and thickness of the cross-sectional form, the distribution of the mesh is the same as that found in ferrocement; and filling the form with concrete to a thickness within the following parameters:

$$(T_c/T_w)^3 = E_w/E_c$$

wherein:

$T_c$ = thickness of the concrete plank, $T_w$ = thickness of the non-concrete plank which is to be duplicated, $E_w$ = modulus of elasticity of the non-concrete plank to be duplicated, and $E_c$ = modulus of elasticity of the concrete plank; and removing the finished concrete plank from the form.

We also provide a method wherein the thickness of the concrete plank is also within the following parameter:

$$S_w/S_c = (T_c/T_w)^2$$

wherein:

$S_w$ = the allowable stress of the non-concrete plank to be duplicated, and $S_c$ = the allowable stress of the concrete plank.

We preferably provide that the mesh has openings that are no greater than 0.75 inches and the layers of mesh are spaced apart no greater than 0.5 inches and the sizes of the wire forming the mesh are such that the total amount of reinforcement is not less than 5 lbs. per cubic foot of reinforced material.

We also provide a method for making a composite mesh reinforced concrete plank which duplicates the flexibility of a non-concrete plank of a given thickness for use in an elevated playing court surface which comprises extruding a mixture of concrete which is combined with layers of mesh which are unrolled through an orifice having a width and length of the non-concrete plank to be duplicated all in such a manner that the mesh is generally uniform and consistently distributed over the length, width and thickness of the concrete plank, the distribution of the mesh is the same as that found in ferrocement and having a thickness within the following parameters:

$$(T_c/T_w)^3 = E_w/E_c$$

wherein:

$T_c$ = thickness of the concrete plank, $T_w$ = thickness of the non-concrete plank which is to be duplicated, $E_w$ = modulus of elasticity of the non-concrete plank to be duplicated, and $E_c$ = modulus of elasticity of the concrete plank.

We further provide a composite mesh reinforced concrete plank for simulating a non-concrete plank for use in an elevated playing court surface which comprises a concrete plank reinforced with spaced layers of mesh having a width and length of the simulated non-concrete plank in such a manner that the mesh is generally uniform and consistently distributed over the length, width and thickness of the cross-section of the plank, the distribution of the mesh is the same as that found in ferrocement and having a thickness within the following parameters:

$$(T_c/T_w)^3 = E_w/E_c$$

wherein:

$T_c$ = thickness of the concrete plank, $T_w$ = thickness of the non-concrete plank which is to be duplicated, $E_w$ = modulus of elasticity of the non-concrete plank to be duplicated, and $E_c$ = modulus of elasticity of the concrete plank.

The concrete plank is also within the following parameters:

$$S_w/S_c = (T_c/T_w)^2$$

wherein:

$S_w$ = the allowable stress of the non-concrete plank to be duplicated, and $S_c$ = the allowable stress of the concrete plank.

It is to be understood that mesh includes metal, wire, expanded metal and other nonferrous fibres.

DESCRIPTION OF A PREFERRED EMBODIMENT OF THE INVENTION Calculations and Examples While we have shown certain objects, purposes and advantages of this invention, other objects, purposes and advantages will become apparent as the following description of the present preferred embodiment proceeds.

Figure 1:
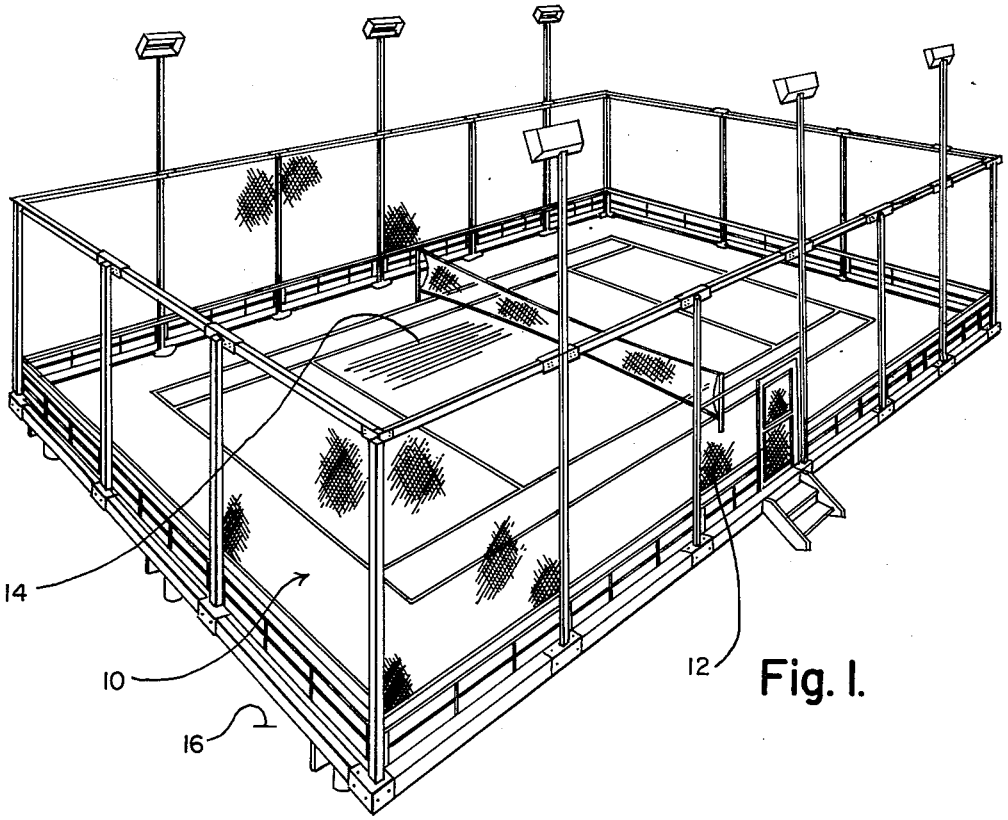
FIG. 1 shows a perspective view of the platform tennis court.

FIG. 1 shows a platform tennis court which measures 30 feet in width and approximately 60 feet in length. The playing area 10 is surrounded by a wire screen 12 to a height of about 12 feet. The planks 14 are spaced to allow water from melting snow to drop to the ground 16 from which the playing area 10 is elevated.

Figure 2:
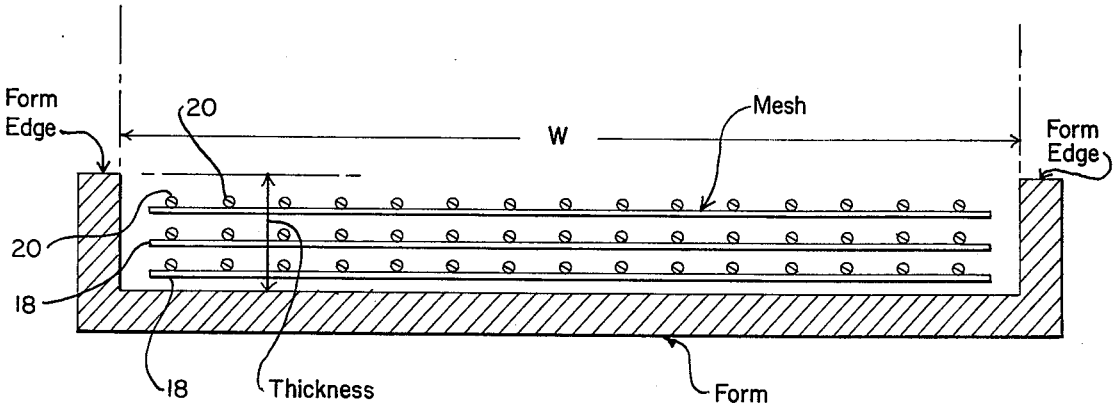
FIG. 2 is a cross-sectional view of a U-shaped form with the layers of mesh positioned in the form.

To duplicate the flexibility of each wooden plank used, layers of metal mesh formed by wires 18 and 20 are placed in a U-shaped form shown in cross-section in FIG. 2. The width W is the width of the wooden plank which is to be duplicated and has a length the same as the wooden plank to be duplicated. The mesh is generally uniform and consistently distributed over the length, width and thickness of the cross-sectional form, the distribution of the mesh is the same as that found in ferrocement. The form is then filled with concrete to a thickness within the following parameters:

$$(T_c/T_w)^3 = E_w/E_c$$

wherein:

$T_c$ = thickness of the concrete plank, $T_w$ = thickness of the wooden plank which is to be duplicated, $E_w$ = modulus of elasticity of the wooden plank to be duplicated, and $E_c$ = modulus of elasticity of the concrete plank.

The finished concrete plank is then removed from the form. The concrete in the form also follows the following parameter:

$$S_w/S_c = (T_c/T_w)^2$$

wherein:

$S_w$ = the allowable stress of the wooden plank to be duplicated, and $S_c$ = the allowable stress of the concrete plank.

The layers of mesh placed in the form are kept in position and spaced within the form by metal reinforcing rods or other suitable devices which could include crimped or folded layers of mesh not shown in the drawing placed between the mesh layers. The reinforcing rods are oriented along the longitudinal axis of the forms. The form is then vibrated to insure proper compaction of the concrete. The top surface of the concrete is textured to provide a skid resistant surface. Coloring can be also added to the concrete to provide the proper coloring. Also heating elements may be inserted within the concrete to melt ice or snow on the playing surface. The mesh has openings that are no greater than 0.75 inches and the layers of mesh are spaced apart no greater than 0.5 inches and the sizes of the wire forming the mesh are such that the total amount of reinforcement is not less than 5 lbs. per cubic foot of reinforced material.

Without the mesh and using only conventional reinforced concrete with steel reinforcement rods near the tension face of the plank, the plank would be constructed of a thickness in the order of 2 inches or more for a typical playing court surface. However, the thickness of such conventionally reinforced concrete planks would cause them to be very stiff and the flexibility to the human foot and feel to the human foot would not duplicate that felt on a wooden court which would be typically on the order of 1 inch thick or more. Concrete planks with the mesh reinforcement provides a playing surface with thicknesses related to span length (distances between the supports) that simulate the flexibility of wood.

The following are calculations which give rise to the parameters which must be maintained in making a concrete plank to simulate a non-concrete (such as a wooden plank) plank of any given width and thickness. The width of the concrete plank can be the same as the wooden plank it is duplicating. However, the thickness in the concrete plank must vary depending upon the flexibility of the wooden plank.

The procedure is shown in the following calculations. The deflection D of a plank of width $b$, thickness $t$, span length L, and modulus of elasticity E, supporting a single mid-span load P and inertia I, is given by:

$$D = PL^3/48\,EI \tag{1}$$

The moment of inertia I is given by:

$$I = bt^3/12 \tag{2}$$

and Equation (1) reduces to:

$$D = PL^3/4b\,(1/Et^3) \tag{3}$$

In comparing planks of equal span length and equal width, the term $PL^3/4b$ can be made a constant $k$, and the deflection of a wooden plank would be:

$$D_w = k/(E_w\,t_w^3) \tag{4}$$

where the subscript $w$ refers to wood, and a concrete plank deflection is:

$$D_c = k/(E_c\,t_c^3) \tag{5}$$

The relation between E and $t$ for a wooden and concrete plank for equal deflection is then:

$$E_w\,t_w^3 = E_c\,t_c^3 \tag{6}$$

or $$E_w/E_c = (t_c/t_w)^3 \tag{7}$$

A common ratio of the modulus of elasticity of wood to the modulus of concrete is 0.5 From Equation (7), the relation between the thickness of wood and concrete planks is:

$$t_c = 0.8\,t_w \tag{8}$$

In other words, the concrete plank is about 80% as thick as a wooden plank for equal flexibility or "springiness" for a given support span length.

It is also necessary to show that the concrete plank made slightly thinner than a wood plank can resist the imposed stresses. The stress in a plank subjected to the previously described load P on a span L is given by:

$$S = 3PL/2b\,(1/L^2) \tag{9}$$

Again, letting the fixed terms P, L and $b$ be a constant $k_2$, $$S = (k_2/t_2) \tag{10}$$

and the ratio of the stresses in wooden and concrete planks is:

$$S_w/S_c = (t_c/t_w)^2 \tag{11}$$

In the previous example, the thickness of the concrete plank was 80% of the wood plank ($t_c = 0.8\,t_w$). From Equation (11), the stresses are related by:

$$S_c = 1.5\,S_w \tag{12}$$

Thus, for a given plank width and span and a given load, the concrete is stressed 50 percent greater than the wood. Only a highly reinforced plank with mesh reinforcement can economically perform under these circumstances.

As an example of a mesh reinforced concrete plank supporting a load of 300 pounds on a span of 36 inches, with an allowable stress of 2000 pounds per square inch and a 9-inch width, the thickness (from Equation (9)) is:

$$T_c \simeq 1 \text{ inch}$$

In summary, the required thickness of a concrete plank relative to a given wooden plank for equal flexibility or "feel" is given by:

$$(t_c/t_w)^3 = E_w/E_c \tag{13}$$

and the corresponding stresses are:

$$S_w/S_c = (t_c/t_w)^2 \tag{14}$$

This invention provides a playing court that will perform as an elevated wooden court surface insofar as flexibility is concerned and yet provide the advantages of being able to have an impregnated color, a non-skid surface, and long life which would reduce maintenance with the ability to build in heating mechanisms.

An additional method for making a concrete plank which duplicates the flexibility of a wooden plank of a given thickness comprises extruding a mixture of concrete which is combined with layers of metal mesh which are unrolled through an orifice having a width and length of the wooden plank to be duplicated in such a manner that the mesh is generally uniform and consistently distributed over the length, width and thickness of the concrete plank, the distribution of the mesh is the same as that found in ferrocement and having a thickness within the following parameters:

$$(T_c/T_w)^3 = E_w/E_c$$

wherein:

$T_c$ = thickness of the concrete plank, $T_w$ = thickness of the wooden plank which is to be duplicated, $E_w$ = modulus of elasticity of the wooden plank to be duplicated, and $E_c$ = modulus of elasticity of the concrete plank.

The concrete plank is also within the following parameter:

$$S_w/S_c = (T_c/T_w)^2$$

wherein:

$S_w$ = the allowable stress of the wooden plank to be duplicated, and $S_c$ = the allowable stress of the concrete plank.

DEFINITIONS OF TERMS

Flexibility — The capacity of a structural member to displace or deflect under the action of an applied load and to return to its original position upon removal of the load. The greater the displacement of the member under any given load, the greater its flexibility.

Ferrocement — A term used to describe a composite material comprising of mortar and finely diffused material which is usually steel but could be other metallic or any non-metallic material. It is essentially a form of reinforced concrete, and exhibits substantially improved properties of toughness, strength and crack resistance. It differs from conventional reinforced concrete in that its reinforcement consists of closely spaced, multiple layers of mesh consistently distributed throughout the length, breadth, and thickness and it is completely impregnated with cement mortar. Ferrocement can be formed in sections less than one inch with only a fraction of an inch of mortar to cover over the mesh layers.

Springiness — The ability of a floor or supporting member to yield to the weight of a person and to go back into its position upon removal of the weight.

Mesh — A closely spaced array of thin elements (such as metal wire). The array is usually rectangular but may also be triangular or octagonal. The mesh may be formed by weaving or fastening the separate elements to each other (as in welding).

Non-concrete plank — A relatively thin supporting element as in a beam made of wood, steel, aluminum, fiberglass, plastic or any constructions thereof.

Mesh consistently distributed — The mesh previously described is placed within the frame or plank in a manner that is not interrupted in the length and breadth direction either by being continuous or, if separate pieces are used, they substantially overlap with cut ends. In the thickness direction, the layers of mesh are evenly distributed between the top and bottom of the frame or plank and are not oriented in such a manner that the plurality of the layers would be grouped together either at the top, middle or bottom of the frame or plank.

Distribution of Mesh Is the Same as That Found in Ferrocement — A plurality of layers of mesh are distributed throughout the thickness of the frame or plank and maintained in their proper structural separations by reinforcing rods or other suitable means and are continuous in the length and breadth of the frame or plank either by virtue of being continuous or by additional overlapping cut ends.

We claim:

1. A method for making a composite mesh reinforced concrete plank which duplicates the flexbility of a non-concrete plank of a given thickness and which has sufficient strength for use in an elevated playing court surface which comprises:

a. placing multiple layers of wire mesh within a U-shaped cross-sectional form having a desired length and width of the non-concrete plank to be duplicated in such a manner that the mesh is generally uniform and consistently distributed over the length, width and thickness of the cross-sectional form, the mesh has openings that are no greater than 0.75 inches and the layers of mesh are spaced apart no greater than 0.5 inches and the sizes of wire forming the mesh are such that the total amount of reinforcement is not less than 5 lbs. per cubic foot of reinforced concrete;

b. filling the form with concrete to a thickness within the following parameters:

$$(T_c/T_w)^3 = E_w/E_c$$

wherein:

$T_c$ = thickness of the concrete plank, $T_w$ = thickness of the non-concrete plank which is to be duplicated and not to exceed two inches in thickness, $E_w$ = modulus of elasticity of the non-concrete plank to be duplicated, and $E_c$ = modulus of elasticity of the concrete plank; and c. removing the finished concrete plank from the form.

2. A method as recited in claim 1 including the step of vibrating the concrete filled form to insure proper compaction.

3. A method as recited in claim 1 wherein the layers of mesh placed in the form are kept in position and spaced within the form by reinforcing rods placed between the mesh layers, the reinforcing rods are oriented along the longitudinal axis of the forms.

4. A method as recited in claim 3 including the step of texturing the top surface of the concrete plank to provide a skid resistant surface.

5. A method as recited in claim 3 including the step of inserting heating elements between the layers of mesh.

6. A method for making a composite mesh reinforced concrete plank which duplicates the flexibility of a non-concrete plank of a given thickness for use in an elevated playing court surface which comprises extruding a mixture of concrete which is combined with layers of mesh which are unrolled through an orifice having a width and length of the non-concrete plank to be duplicated in such a manner that the mesh is generally uniform and consistently distributed over the length, width and thickness of the concrete plank form within the following parameters:

$$(T_c/T_w)^3 = E_w/E_c$$

wherein:

$T_c$ = thickness of the concrete plank, $T_w$ = thickness of the non-concrete plank which is to be duplicated and not to exceed two inches in thickness, $E_w$ = modulus of elasticity of the non-concrete plank to be duplicated, and $E_c$ = modulus of elasticity of the concrete plank, the mesh has openings that are no greater than 0.75 inches and the layers of mesh are spaced apart no greater than 0.5 inches and the sizes of wire forming the mesh are such that the total amount of reinforcement is not less than 5 lbs. per cubic foot of reinforced concrete.

7. A method as recited in claim 6 including forming surface indentations to provide skid resistance.

8. A method as recited in claim 7 including placing heating elements within the concrete plank as it is extruded.

9. A method for making a composite mesh reinforced concrete plank which duplicates the flexibility of a non-concrete plank of a given thickness for use in an elevated playing court surface which comprises forming a mixture of concrete and distribiting layers of mesh to the desired length and width of the non-concrete plank to be duplicated in such a manner that the mesh is generally uniform and consistently distributed over the length, width and thickness of the concrete plank within the following parameters:

$$(T_c/T_w)^3 = E_w/E_c$$

wherein:

$T_c$ = thickness of the concrete plank, $T_w$ = thickness of the non-concrete plank which is to be duplicated and not to exceed 2 inches in thickness, $E_w$ = modulus of elasticity of the non-concrete plank to be duplicated, and $E_c$ = modulus of elasticity of the concrete plank, the mesh has openings that are no greater than 0.75 inches and the layers of mesh are spaced apart no greater than 0.5 inches and the sizes of wire forming the mesh are such that the total amount of reinforcement is not less than 5 lbs. per cubic foot of reinforced concrete.

10. A method as recited in claim 1 wherein the layers of mesh placed in the form are kept in position by crimped layers of mesh.

11. A method as recited in claim 1 wherein the layers of mesh placed in the form are kept in position by folded layers of mesh.

12. A method as recited in claim 6 wherein the layers of mesh are kept in position by crimped layers of mesh.

13. A method as recited in claim 6 wherein the layers of mesh are kept in position by folded layers of mesh.

* * * * *

UNITED STATES PATENT OFFICE

CERTIFICATE OF CORRECTION

Patent No. 4,070,427 Dated January 24, 1978

Inventor(s) JAMES P. ROMUALDI et al.

It is certified that error appears in the above-identified patent and that said Letters Patent are hereby corrected as shown below:

Column 1, lines 23 and 24, "as now" should read --snow--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*